US005240140A

United States Patent [19]

Huen

[11] Patent Number: 5,240,140

[45] Date of Patent: Aug. 31, 1993

[54] CARD DISPENSER

[76] Inventor: Hing-Wah Huen, c/o Fairform Mfg. Co., Ltd. of 5/F, Shing King Industrial Building, 206-208 Choi Hung Road, San Po Kong, Kowloon, Hong Kong

[21] Appl. No.: 762,858

[22] Filed: Sep. 18, 1991

[30] Foreign Application Priority Data

Feb. 12, 1991 [GB] United Kingdom ..... 9102902

[51] Int. Cl.[5] ..... A63F 1/12

[52] U.S. Cl. ..... 221/13; 221/252; 221/259; 273/149 R; 273/149 P

[58] Field of Search ..... 221/252, 258, 259, 268, 221/270, 13, 232; 271/42, 279, 298; 273/149 R, 149 P

[56] References Cited

U.S. PATENT DOCUMENTS 4,309,035 1/1982 Goldfarb .
4,310,160 1/1982 Willette et al. .
4,497,488 2/1985 Plevyak et al. .
4,586,712 5/1986 Lorber et al. .
4,618,072 10/1986 Yoshikawa ..... 221/252 X
4,728,090 3/1988 Oota et al. ..... 221/252 X
4,951,950 8/1990 Normand et al. .

FOREIGN PATENT DOCUMENTS 8103239 1/1993 Netherlands .
1176628 2/1968 United Kingdom .
1454931 8/1974 United Kingdom .
1456051 11/1976 United Kingdom .
2152018A 12/1984 United Kingdom .

*Primary Examiner*—David H. Bollinger
*Attorney, Agent, or Firm*—Browning, Bushman, Anderson & Brookhart

[57] ABSTRACT

A card dispenser (32) comprising a body (33) having a compartment (38) for accommodating a stack of cards (39) and at least one outlet (43) through which cards (39) accommodated in the compartment (38) can be dispensed, transporting mechanism (41) provided in the body (33) and arranged to transport a card (39) from the said stack so accommodated towards the said or one of the said at least one outlet (43), and a random device (47) arranged to cause the or some of the cards (39) to be dispensed one by one to a plurality of locations in a random manner.

21 Claims, 2 Drawing Sheets

CARD DISPENSER

The present invention relates to a card dispenser, particularly but not exclusively, for playing cards.

Cards can be used in games or fortune telling or for other purposes, and it is usually necessary to shuffle them thoroughly and to deal or distribute them in a particular manner before use. Cards are popular for games, but it takes time as well as skill manually to shuffle them thoroughly and to distribute them in a neat manner, which is rather tedious and introduces dead time between games.

According to the invention, there is provided a card dispenser which comprises a body having a compartment for accommodating a stack of cards and at least one outlet through which cards accommodated in the compartment can be dispensed, transporting means provided in the body and arranged to transport a card from the said stack so accommodated towards the said or one of the said at least one outlet, and random means arranged to cause the or some of the cards to be dispensed one by one to a plurality of locations in a random manner.

Preferably, the card dispenser further comprises a pair of rollers pressing against each other, which rollers are provided within the body and behind the or each said at least one outlet and are operable to deliver through the or the corresponding outlet a said card transported by said transporting means towards the said outlet.

In a preferred embodiment, the body has four outlets, and said random means is arranged to control said transporting means to transport a card from a said stack towards one of the outlets in a random manner.

It is preferred that the four outlets are provided around the compartment, thereby defining four corresponding locations around the body to which said cards are to be dispensed.

In another preferred embodiment, the body has a base part and a movable part movable relative to the base part, on which movable part a single outlet is provided, and said random means is arranged to control in a random manner the movement of the movable part relative to the base part to one of plurality of positions corresponding to the said locations.

Preferably, the movable part of the body is rotatable about the base part to four different angular positions.

It is preferred that said transporting means comprises a movable member which is arranged to engage by friction the uppermost or lowermost card of a said stack and thereby to transport upon movement the said card.

Preferably, said transporting means further comprises a solenoid or alternatively an electric motor for moving the movable member.

Advantageously, said transport means is provided on one side of the compartment, and resilient means is provided on the opposite side of the compartment to urge a said stack of cards placed in the compartment towards said transport means.

It is preferred that the card dispensers further comprise an electronic control circuitry to enable a user to control the random manner in which said cards are to be dispensed.

Preferably, the electronic control circuitry has a function to permit the number of said locations to be preset.

Preferably, the electronic control circuitry has a function to permit the number of cards to be dispensed to each location to be preset.

The invention will now be more particularly described, by way of example only, with reference to the accompanying drawings, in which.

Figure 1:
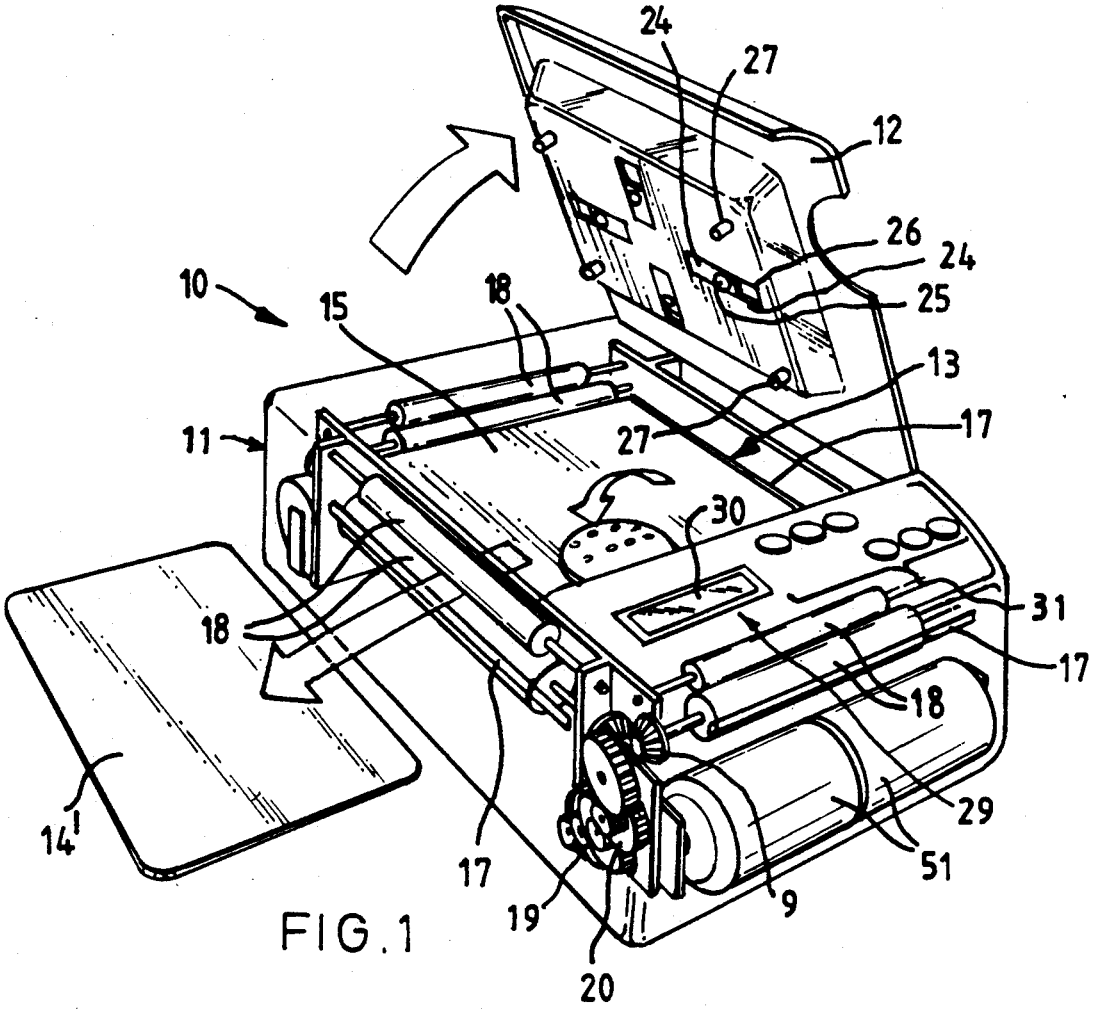
FIG. 1 is a perspective view of a first embodiment of a card dispenser in accordance with the invention.
Figure 2:
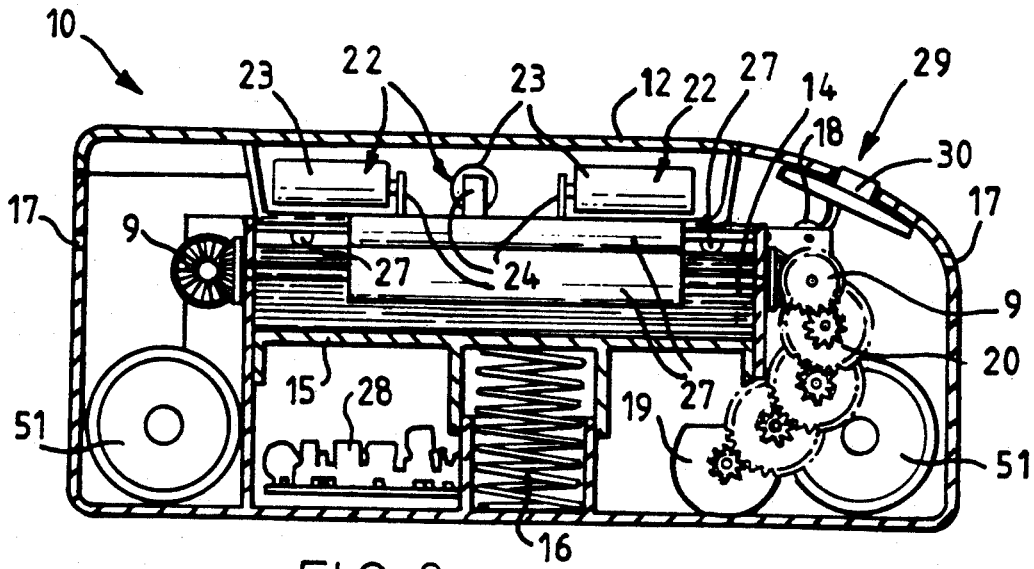
FIG. 2 is a sectional side view of the card dispenser of FIG. 1.

Referring firstly to FIGS. 1 and 2, there is shown a first embodiment of a card dispenser 10 according to the invention, which includes a cubical body 11 having a lid 12 and a compartment 13 for accommodating a stack of cards 14 (see FIG. 2). The compartment 13 has a base plate 15 which is resiliently biassed upwards by a spring co-acting between which and the base wall of the body 11, whereby the stack of cards 14 is urged by the base plate 15 against the lid 12 when the latter is closed.

At the same level as the top of the stack of cards 14, each side wall of the body 11 has a horizontal slot 17 behind which there is provided a pair of rubber rollers 18. The rollers 18 of each pair extend in a parallel manner and press against each other longitudinally and at the same level as the slots 17. All the four lower rollers 18 are engaged together by bevel gears 9 and simultaneously drivenable by an electric motor 19 through a train of gears 20 to rotate towards at that level the corresponding slots 17. The rollers 18 of each pair are thereby operable to dispense a card 14', placed therebetween from behind, through the corresponding slot 17 and out of the body 11.

Inside the lid 12 there are provided four actuators 22, each consisting of a solenoid 23 and an associated slider 24. Each slider 24 has a rubber gripping portion 25 which projects downwardly out of the bottom wall of the lid 12 through a slot 26, and is slidable linearly and at a small depression angle from an inner position by the associated solenoid 23 towards the corresponding nearest slot 17 and to an outer position, against the action of an associated spring (not shown) which biasses the slider 24 towards the inner position. It is appreciated that the gripping portions 25 project more downwardly at the outer position than at the inner position.

The bottom wall of the lid 12 has four depending corner studs 27 which project slightly more downwardly than the gripping portions 25 when the latter are in their inner positions, but not when the latter are in their outer positions, so that the uppermost card 14 of the stack inside the compartment 13 is spaced away by the studs 27 from the inactive actuators 22.

As soon as a particular solenoid 23 is energised, the corresponding slider 24 will be moved outwards as well as downwards, and eventually its gripping portion 25 will come into contact with the uppermost card 14 and engage therewith by friction, thereby transporting the said card 14 to the corresponding pair of dispensing rollers 18. The gripping friction of each roller pair 18 on the card 14 in transit is sufficiently large to overcome that of the corresponding operating actuator 22 (gripping portion 25). The operating time of each actuator 22 is long enough to enable the card 14 in transit to reach the corresponding roller pair 18, but not too long in order to ensure that the slider 24 in action will return to its inner position or close enough thereto to bring its gripping portion 25 off the said card 14, whereby the next card 14 will not be disturbed.

To achieve the effect of card shuffling, the card dispenser 10 includes a microprocessor-based electronic circuitry 28 which controls the operation of the actuators 22 in a random order. In other words, even if the cards 14 are stacked in a particular order and to be dispensed one by one downwards in that order, the directions in which or the locations (four sides of the body 11) to which they are to be dispensed will be in an unpredictable manner.

Despite of the random order in which the actuators 22 are operated, the electronic circuitry 28 will ensure (by means of counters) that the cards 14 be distributed at the end in a particular manner according to the card game to be played, such as four suits of thirteen cards for a bridge game. In the case of playing games such as poker, the card dispenser 10 can be controlled to dispense a single card at one time. The distribution mode is presettable by a user through a control panel 29 on the body 11. The control panel 29 has a liquid crystal display 30 and six buttons 31, and also enables a user to switch on/off and to start or interrupt the operation of the card dispenser 10, to input the number of locations (players), and to disable the shuffling function.

Figure 3:
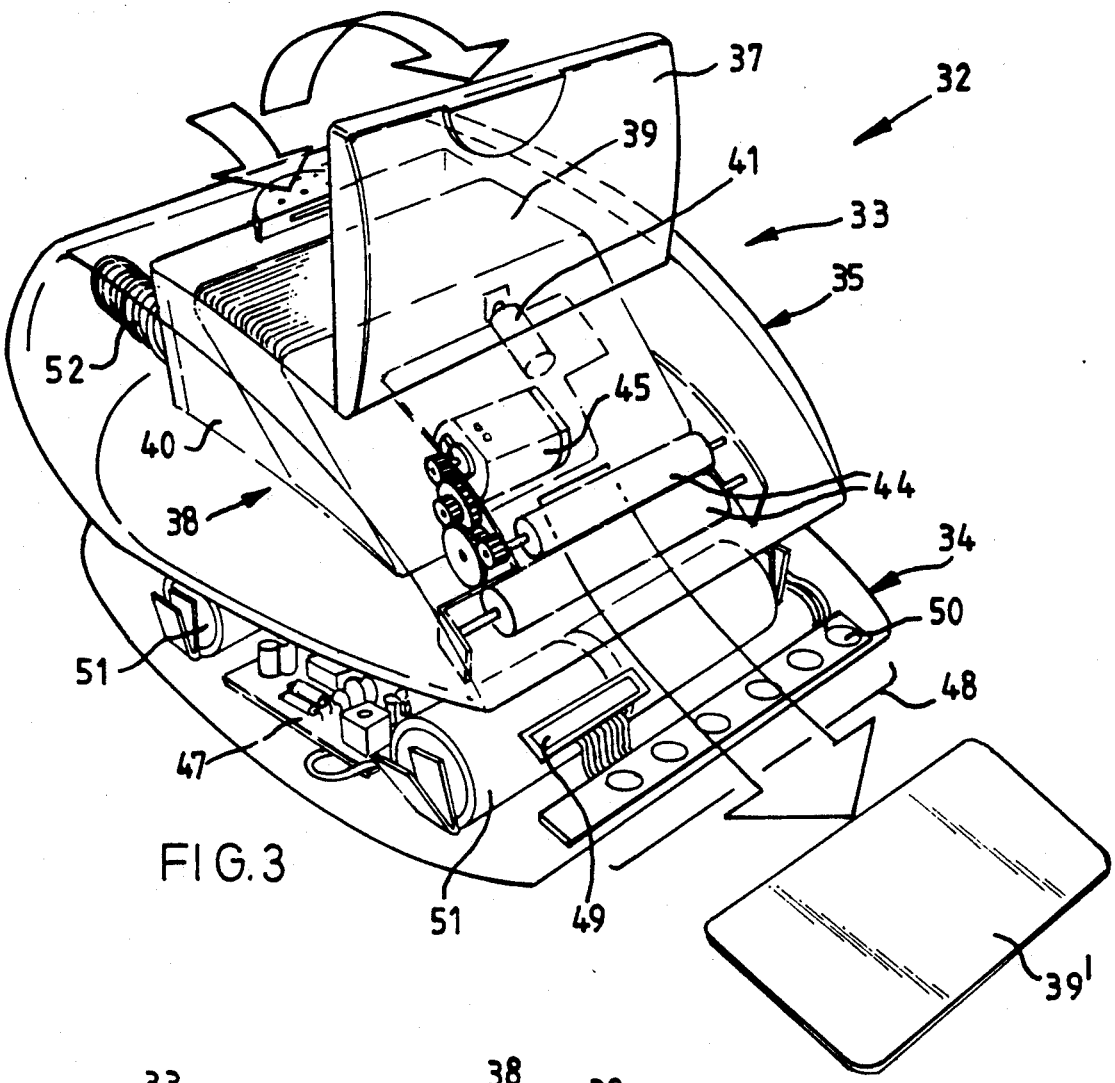
FIG. 3 is a perspective view of a second embodiment of a card dispenser in accordance with the invention.
Figure 4:
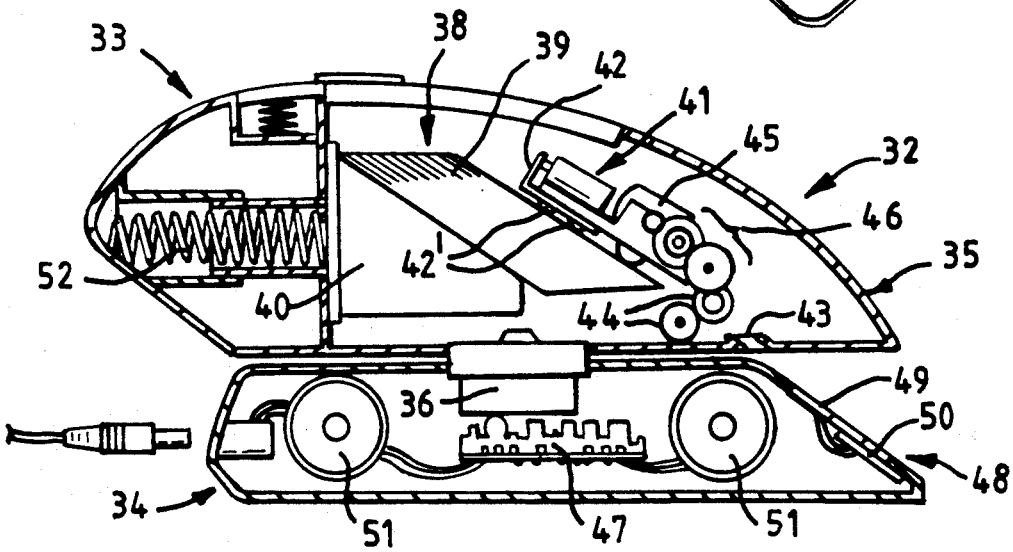
FIG. 4 is a sectional side view of the card dispenser of FIG. 3.

FIGS. 3 and 4 show a second embodiment of a card dispenser 32 according to the invention, which includes a body 33 having a base part 34 and a head part 35. The head part 35 is rotatably supported on the base part 34 by an electric stepping motor 36, and has a lid 37 and a compartment 38 under the lid 37 for accommodating a stack of cards 39 in a slant manner. The rear side of the compartment 38 is provided by a wedge member 40 which is resiliently biassed forwards by a spring 52 so as to urge the stack of cards 39 forwards against studs 53 on the lid 37.

An actuator 41 is provided within the front portion of the head part 35, which is substantially the same as the actuators 22 of the card dispenser 10 and operates in the same manner, except including a slider 42 having two gripping portions 42' for enhanced card gripping.

Below the front portion of the head part 35, there is provided a horizontal slot 43 lying in at the same plane as the top of the stack of cards 39. A pair of dispensing rollers 44 is likewise provided on that plane between the top of the stack of cards 39 and the slot 43. The rollers 44 are drivenable by an electric motor 45 through a train of gears 46 which are located on the same support as the actuator 41, and operate in the same manner as the rollers 18 described above.

The card dispenser 32 includes a microprocessor-based electronic control circuitry 47 for controlling, by means of the stepping motor 36, the orientation of the head part 35 relative to the base part 34. There are four possible orientations for the head part 35, namely to the front, rear and both sides of the base part 34, and the head part 35 is rotatable to these different orientations in a random order so as to dispense the cards 39 to corresponding locations in an unpredictable manner.

As best shown in FIG. 3, the base part 34 has a control panel 48 provided with a liquid crystal display 49 and six buttons 50, through which the operation of the control circuitry 47 and in turn the card dispenser 32 can be controlled by a user in the same way as described in connection with the card dispenser 10.

Both card dispensers 10 and 32 may be powered by battery cells 51 or mains supply through a power adaptor.

In use, either card dispenser 10 or 32 may be placed in the centre of a table, with four sides facing the corresponding players if there are four.

It is envisaged that a card dispenser according to the invention may have a track and a card dispensing unit slidable along the track to dispense cards from a stack to up to four or more than four different locations in a row, or may be designed to dispense cards starting with the bottom or lowermost card.

The invention has been described by way of example only, and various other modifications of and/or alterations to the described embodiments may be made by a person skilled in the art without departing from the scope of the invention as specified in the appended claims.

I claim:

1. A card dispenser comprising a body having a compartment for accommodating a stack of cards and at least four outlets through which cards accommodated in the compartment can be dispensed, transporting means provided in the body and arranged to transport a card from the said stack so accommodated towards one of the said at least four outlets, and random means arranged to cause at least some of the cards to be dispensed one by one to a plurality of locations in a random manner, and to control said transporting means to transport a card from a said stack towards one of the outlets in a random manner.

2. A card dispenser as claimed in claim 1, further comprising a pair of rollers pressing against each other, which rollers are provided within the body and behind at least one of the said at least four outlets and are operable to deliver through the corresponding outlet said card transported by said transporting means towards the said outlet.

3. A card dispenser as claimed in claim 1, wherein the at least four outlets are provided around the compartment, thereby defining at least four corresponding locations around the body to which said cards are to be dispensed.

4. A card dispenser as claimed in claim 1 or claim 2, wherein said transporting means comprises a movable member which is arranged to engage by friction the uppermost or lowermost card of said stack and thereby to transport upon movement the said card.

5. A card dispenser as claimed in claim 4, wherein said transporting means further comprises a solenoid for moving the movable member.

6. A card dispenser as claimed in claim 4, wherein said transporting means further comprises an electric motor for moving the movable member.

7. A card dispenser as claimed in claim 4, wherein said transport means is provided on one side of the compartment, and resilient means is provided on the opposite side of the compartment to urge said stack of cards placed in the compartment towards said transport means.

8. A card dispenser as claimed in claim 1 or claim 2, further comprising an electronic control circuitry to enable a user to control the random manner in which said cards are to be dispensed.

9. A card dispenser as claimed in claim 8, wherein the electronic control circuitry has a function to permit the number of said locations to be preset.

10. A card dispenser as claimed in claim 8, wherein the electronic control circuitry has a function to permit the number of cards to be dispensed to each location to be preset.

11. A card dispenser comprising a body having a compartment for accommodating a stack of cards and at least one outlet through which cards accommodated in the compartment can be dispensed, transporting means provided in the body and arranged to transport a card from the said stack so accommodated towards said at least one outlet, said transporting means comprising a movable member which is arranged to engage by friction the uppermost or lowermost card of said stack and thereby to transport upon movement the said card, and random means arranged to cause at least some of the cards to be dispensed one by one through the at least one outlet to a plurality of locations in a random manner.

12. A card dispenser as claimed in claim 11, wherein said transporting means further comprises a solenoid for moving the movable member.

13. A card dispenser as claimed in claim 11, wherein said transporting means further comprises an electric motor for moving the movable member.

14. A card dispenser as claimed in claim 11, wherein the transport means is provided on one side of the compartment, and resilient means is provided on the opposite side of the compartment to urge said stack of cards placed in the compartment towards said transport means.

15. A card dispenser as claimed in claim 11, further comprising an electronic control circuitry to enable a user to control the random manner in which said cards are to be dispensed.

16. A card dispenser comprising a body having a compartment for accommodating a stack of cards and at least one outlet through which cards accommodated in the compartment can be dispensed to a plurality of predetermined locations around the body, transporting means provided in the body and arranged to transport a card from the said stack so accommodated towards said at least one outlet, and random means arranged to cause at least some of the cards to be dispensed one by one through the at least one outlet to the plurality of predetermined locations around the body in a random order of the locations.

17. A card dispenser as claimed in claim 16, wherein the body has at least four outlets, and said random means is arranged to control said transporting means to transport a card from said stack towards one of the outlets in a random order.

18. A card dispenser as claimed in claim 16, wherein said transporting means comprises a movable member which is arranged to engage by friction the uppermost or lowermost card of said stack and thereby to transport upon movement the said card.

19. A card dispenser as claimed in claim 18, wherein said transport means is provided on one side of the compartment, and resilient means is provided on the opposite side of the compartment to urge said stack of cards placed in the compartment towards said transport means.

20. A card dispenser as claimed in claim 16, further comprising an electronic control circuitry to enable a user to control the random manner in which said cards are to be dispensed.

21. A card dispenser as claimed in claim 16, further comprising a pair of rollers pressing against each other, which rollers are provided within the body and behind the said at least one outlet and are operable to deliver through the corresponding outlet said card transported by said transporting means towards the said outlet.

* * * * *

UNITED STATES PATENT AND TRADEMARK OFFICE

CERTIFICATE OF CORRECTION

PATENT NO. : 5,240,140

DATED : August 31, 1993

INVENTOR(S) : Hing-Wah Huen

It is certified that error appears in the above-identified patent and that said Letters Patent is hereby corrected as shown below:

On the title page, item:

(73) Assignee: Fairform Mfg. Co., Ltd.
5/F, Shing King Industrial Building 206-208 Choi Hung Road,
San Po Kong Kowloon, Hong Kong Signed and Sealed this Seventh Day of June, 1994

Bruce Lehman

*Attest:*

BRUCE LEHMAN

*Attesting Officer*

*Commissioner of Patents and Trademarks*